US006242707B1

(12) United States Patent
Mody et al.

(10) Patent No.: US 6,242,707 B1
(45) Date of Patent: Jun. 5, 2001

(54) ARC QUENCHING CURRENT LIMITING DEVICE INCLUDING ABLATIVE MATERIAL

(75) Inventors: Hemant K. Mody, Avon, CT (US); Anil R. Duggal, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/386,778

(22) Filed: Aug. 31, 1999

(51) Int. Cl.[7] ..... H01H 9/30; H01H 33/02

(52) U.S. Cl. ..... 218/1; 218/22; 218/143; 218/146; 218/150; 218/157; 335/195; 335/201

(58) Field of Search ..... 218/1, 22–42, 218/43–84, 85, 90, 117, 149–151, 155–158, 146, 152, 143–145; 337/158–162, 273–276, 279, 280, 282; 335/7–10, 18, 19, 99, 100, 155, 195, 201, 202

(56) References Cited

U.S. PATENT DOCUMENTS 4,170,394 * 10/1979 Conway ..... 218/90 X
4,562,320 * 12/1985 Van Der Scheer ..... 218/1
4,594,489 * 6/1986 Gengenbach et al. ..... 218/117
4,752,660 * 6/1988 Yokoyama et al. ..... 218/117
4,778,958 * 10/1988 Mayer et al. ..... 218/146

* cited by examiner

*Primary Examiner*—J. R. Scott
(74) *Attorney, Agent, or Firm*—Cantor Colburn LLP; Carl B. Horton

(57) ABSTRACT

A current limiting device for protecting electrical circuits has a case and a pair of separable electrodes disposed within the case. Each electrode has a plurality of openings with an ablative member abutting the openings at an outer surface of the electrode. A spring is disposed between each ablative member and the case for urging the electrodes together. When the electrical current exceeds a predetermined set-point the electrodes separate and an arc is created between the electrodes. The arc heats the ablative member causing expulsion of gasses which further increase the gap resistance and cool the arc to thereby quenching the arc. In a second embodiment of the current limiting device, one of the electrodes is a fixed electrode. The ablative member is disposed about a surface of the moveable electrode with a plurality of legs passing through a plurality of openings of the moveable electrode and in contact with an inner surface of the fixed electrode. A plurality of ablative member springs urges the ablative member against the fixed electrode and a plurality of electrode springs urge the movable electrode against the fixed electrode. In the second embodiment the efficiency of the expulsion of gasses is increased because the legs of the ablative member are positioned within the arc.

26 Claims, 3 Drawing Sheets

ARC QUENCHING CURRENT LIMITING DEVICE INCLUDING ABLATIVE MATERIAL

BACKGROUND OF THE INVENTION

This invention relates to the field of high power voltage, circuit interruption devices and more particularly to arc quenching expulsion current limiting devices.

Current limiting devices require the rapid development of arc voltage. Prior art shows the use of conductive material filled polymers as contact materials (Ref. U.S. Pat. No. 4,778,958). Such contact materials, while showing good arc quenching capability, show high contact resistance and high erosion rate.

BRIEF SUMMARY OF THE INVENTION

In an exemplary embodiment of the invention, a current limiting device for protecting electrical circuits includes a pair of separable electrodes disposed within a case. Each electrode has at least one opening with an ablative member abutting the opening at an outer surface of the electrode. A spring is disposed between each ablative member and the case for urging the electrodes together.

In another embodiment of the present invention, a current limiting device includes a first and second separable electrodes disposed in the case. The second electrode has at least one opening for receiving a member formed of ablative material. The ablative member includes a leg portion that passes through the opening of the second electrode to contact the first electrode. An ablative member spring urges the ablative member against the first electrode, and an electrode spring urging the second electrode against the first electrode.

DETAILED DESCRIPTION OF THE INVENTION

Figure 1:
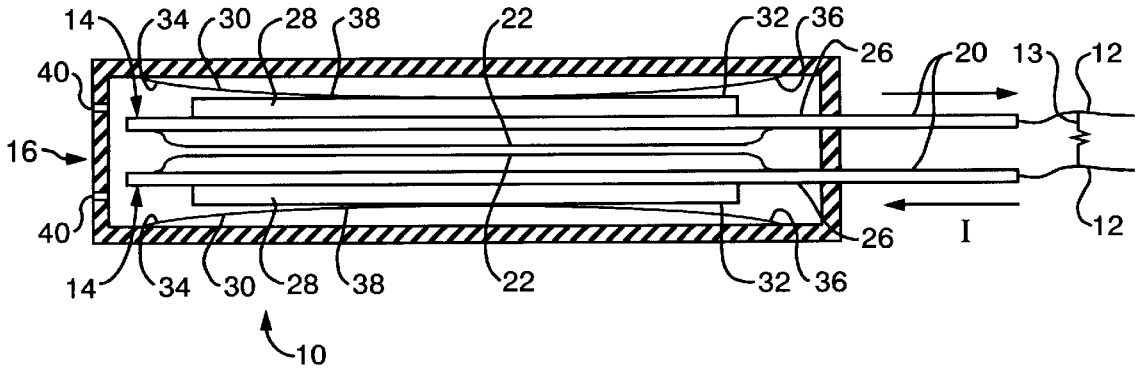
FIG. 1 is a cross-sectional view of one embodiment of the current limiting device of the present invention.

Referring to FIG. 1, an exemplary embodiment of an arc quenching expulsion current limiting device is shown generally at 10. The current limiting device 10 is located within a current carrying loop of an electric circuit (not shown). The current limiting device is coupled in series with a power source and a load via leads 12 to provide short circuit protection. Any current in the current carrying conductor therefore will pass from the power source, through the current limiting device and to the load.

The current limiting device 10 comprises two opposing separable electrodes 14 disposed within a generally rectangular case 16. Each electrode is substantially planar having a generally rectangular shape. The electrodes 14 comprise an electrically conductive material. Examples of suitable conductive materials include copper, silver, silver plated copper and any of the electrical contact materials such as silver tungsten, silver cadmium-oxide and silver tin-oxide. In the alternative, the electrodes may also be formed of thermal-electric heating materials, such as a bimetal, to aid the electromagnetic force urging the contacts apart. Furthermore, other magnetic arrangements may be added to aid in faster and greater contact separation.

The case 16 is constructed from a non-conducting material, such as a polymeric material. Preferably, the case includes vent holes 40 to permit the release of gases produced during operation of the current limiting device. Each wire lead 12 is attached to a respective end 20 of each electrode 14 that passes through the case 16. By surrounding at least one of the conductors with a magnetic material such as steel and attaching steel to the electrode(s) to form in effect a solenoid, the electromagnetic force urging the contacts apart can be enhanced.

Figure 2:
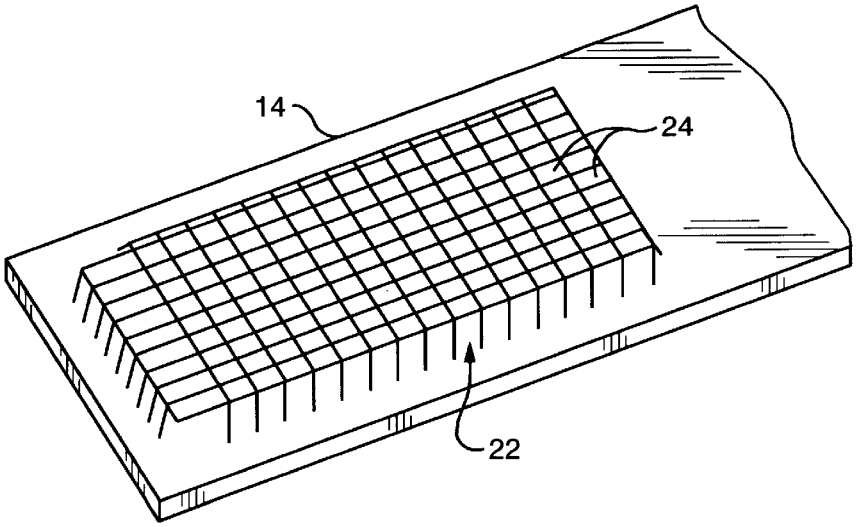
FIG. 2 is a partial perspective view of an electrode of the current limiting device of FIG. 1.

Referring now to both FIGS. 1 and 2, each electrode 14 has an inner contact portion 22, opposing each other. The inner contact portion 22 includes a plurality of openings 24 disposed therein. The inner contact portions may be formed of a meshed material. The inner contact portions further extend inwardly to provide a trough 26 for receiving a strip 28 formed of ablative material, which will be described hereinafter in greater detail. The inner contact portions 22 of the electrodes electrically contact each other when disposed in the closed position to permit conduction of the current from one lead 12 to the other. The openings 24 of the inner contact portions 22 further permit the heat and gasses of a gap created arc to rapidly interact with the ablative strip. It can be appreciated that other porous material or structures having a plurality of openings 24, such as wire mesh or grate, are also suitable.

The strip 28 comprises an ablative material such as cellulose filled melamine formaldehyde, nylon, and epoxy. The ablative material is a material which ablates and emits gas at temperatures greater than 200C. The material can be a polymer material such as a thermoplastic (for example, polytetrafluoroethylene, poly(ethyleneglycol), polyethylene, polycarbonate, polyimide, polyamide, polyoxymethylene, polymethylmethacrylate, polyester, etc.); a thermoset plastic (for example, epoxy, polyester, polyurethane, phenolic, alkyd); or an elastomer (for example silicone (polyorganosiloxane), (poly)urethane, isoprene rubber, neoprene, etc.).

In addition, the polymer material can be filled with a filler to improve specific properties such as the mechanical properties, dielectric properties, or to provide enhance arc-quenching properties or flame-retardant properties. Materials which could be used as filler include: a filler selected from reinforcing fillers such as fumed silica, or extending fillers such as precipitated silica and mixtures thereof. Other fillers include titanium dioxide, lithopone, zinc oxide, diatomaceous silicate, silica aerogel, iron oxide, diatomaceous earth, calcium carbonate, silazane treated silicas, silicone treated silicas, glass fibers, magnesium oxide, chromic oxide, zirconium oxide, alpha-quartz, calcined clay, carbon, graphite, cork, cotton sodium bicarbonate, boric acid, alumina-hydrate, etc. Other additives may include: impact modifiers for preventing damage to the material such as cracking upon sudden impact; flame retardant for preventing flame formation and/or inhibiting flame formation in the current limiter; UV screens for preventing reduction in component physical properties due to exposure to sunlight or other forms of UV radiation.

The ablative strip 28 is generally rectangular having a predetermined size generally equal to the dimensions of the trough 26 of the electrodes 14. More specifically, the ablative strip is disposed over the plurality of openings 24 of the inner contact portions 22. The thickness of the ablative strip 28 is greater than the depth of the trough 26 such that the strip extends beyond the trough.

A pair of leaf springs 30 are disposed in the case 16 to urge and compress the strips 28 of ablative material, disposed in the electrodes 14 together. Each leaf spring 30 is set between an inner surface of the case 16 and an outer surface 32 of each ablative strip 28. Ends 34, 36 of each leaf spring 30 are mounted onto the case. A central portion 38 of each spring engages each respective ablative strip 22 to springably compress the ablative strips and the electrodes 14 together.

When the current limiting device 10 is connected in series with the load, the leaf springs 30 maintain the raised inner contact portion 22 of each electrode 14 in contact during normal operation. The electric current flowing through the electrodes 14 creates an electromagnetic force urging the electrodes apart. The electromagnetic force urging the electrodes open is directly proportional to the current flowing through the wires. Opposing the electromagnetic force are leaf springs 30, each spring urging its respective electrode 17 towards the opposing electrode 14 and maintaining the electrodes closed as described hereinbefore. The electrodes part when the force of the current overcomes the force of the leaf springs 30. One skilled in the art would appreciate that the stiffness of the spring changes the set point of the device 10, i.e., a stiffer spring results in a higher setpoint. A resistor 13 may also be electrically connected in parallel with the device 10, such as between the leads 12, may be used to minimize gas pressure and promote rapid arc quenching.

When an overcurrent or ground fault condition occurs, the electrodes 14 separate, creating a gap between the electrodes that results in a high voltage arc forming therebetween. The arc rapidly generates heat and ionizing gasses. The plurality of openings 24 on the electrodes 14 facilitates the transfer of heat from the arc and promotes the intermixing of the evolved gases from the ablative strips 28 with the plasma created by the arc.

The heat further causes the strips 28 of ablative material to gasify. The gasses from the ablative strip decrease the conductivity within the gap, cool the electrodes 14 along the arc length and also create a high-pressure region to further force the electrodes open. The disposition of the ablative strips on the openings 24 results in a rapid and high gap voltage build up terminating the overcurrent condition. As described hereinabove, the vent 40 permits expulsion of the gasses to limit the high-pressure in the case 19.

Figure 3:
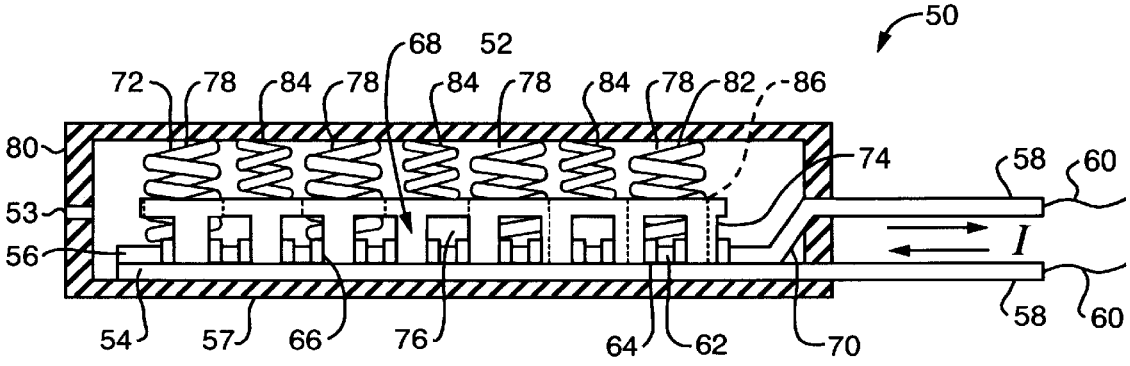
FIG. 3 is a cross-sectional view of an alternate embodiment of the current limiting device of the present invention.
Figure 4:
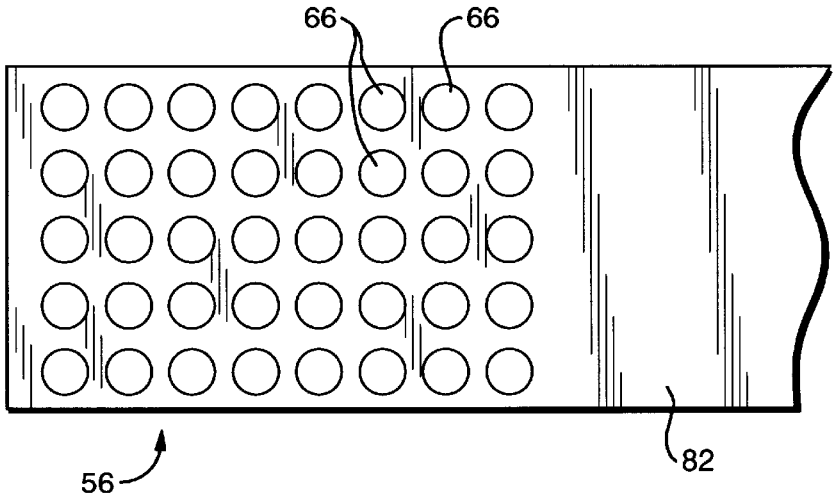
FIG. 4 is a partial top plan view of a movable electrode of the alternate embodiment of the current limiting device of FIG. 3.

Referring to FIG. 3, an alternative embodiment of the current limiting device is shown generally at 50. The device comprises a case 52, having a vent 53 that houses a fixed electrode 54 and an opposing movable electrode 56. One end 58 of each electrode 54, 56 passes through the case 52 and is attached to wire leads 60 respectively. The fixed electrode 54 and movable electrode 56 is formed of an electrically conductive material as described hereinabove. The fixed electrode 54 is supported within the case 52 by a bottom surface 57 of the case 52. The fixed electrode 54 is generally a solid rectangular strip. An inner end 62 of the movable electrode 56 is in electrical contact with an inner surface 64 of the fixed electrode 54. The inner end 62 of the movable electrode 56 includes a plurality of through openings 66, as best shown in FIG. 4, for receiving an ablative member 68. At an intermediate portion 70 of the movable electrode 56, the movable electrode steps upward, away from the fixed electrode 54 to separate the ends 58 of the electrodes a predetermined distance.

The ablative member 68 is composed of an ablative material, similar to that described hereinabove. The ablative member has a rectangular planar portion 72 from which a plurality of cylindrical legs 74 depends downwardly therefrom. The legs 74 of the ablative member 68 have a diameter less than the diameter of the openings 66 of the movable electrode 56 to permit passage of the legs 74 through the openings 66 and to permit free movement of the movable electrode 56 about the legs (to be described hereafter). The legs 74 are of a predetermined length longer than the thickness of the movable electrode 56 to permit the legs to contact an inner surface 64 of the fixed electrode 54 and allow movement of the moveable electrode. A space 76 disposed between the moveable electrode and the rectangular portion of the ablative member 68 defines the arc quenching gap.

A plurality of electrode springs 78 are interposed between the case 80 and the outer surface 82 of the moveable electrode 56. The electrode springs 78 pass through openings in the ablative member 72 to engage the movable electrode 56. The springs are coil springs and compressively urge the movable electrode 56 downward against the fixed electrode 54. The setpoint of the current limiting device 50 is dependent on the compressive force of the electrode springs 78.

In addition to the electrode springs 78, a plurality of ablative member springs 84 are interposed between the case 80 and an opposing surface of the rectangular portion 72 of the ablative member 68. The springs 84 urge the cylindrical legs 74 against the inner surface 64 of the fixed electrode 54 by the springs 84 to maintain the legs 74 against the fixed electrode during the operation of the current limiting device 50.

During normal operating condition, the springs 78, 84 urge, respectively, the ablative member 68 and the movable electrode 56 against the fixed electrode 54 to conduct current to the protected load. When an overcurrent or ground fault condition occurs, the movable electrode 56 is repelled upward and away from the fixed electrode 54. As described hereinbefore, the electrode springs 78 define the setpoint of the current trip level of the current limiting device. As the movable electrode repels from the fixed electrode, the ablative member 68 is maintained continually in contact with the fixed electrode during the operation of the current limiting device 50. The ablative member acts to quench the arc created between the electrodes 54, 56.

Figure 5:
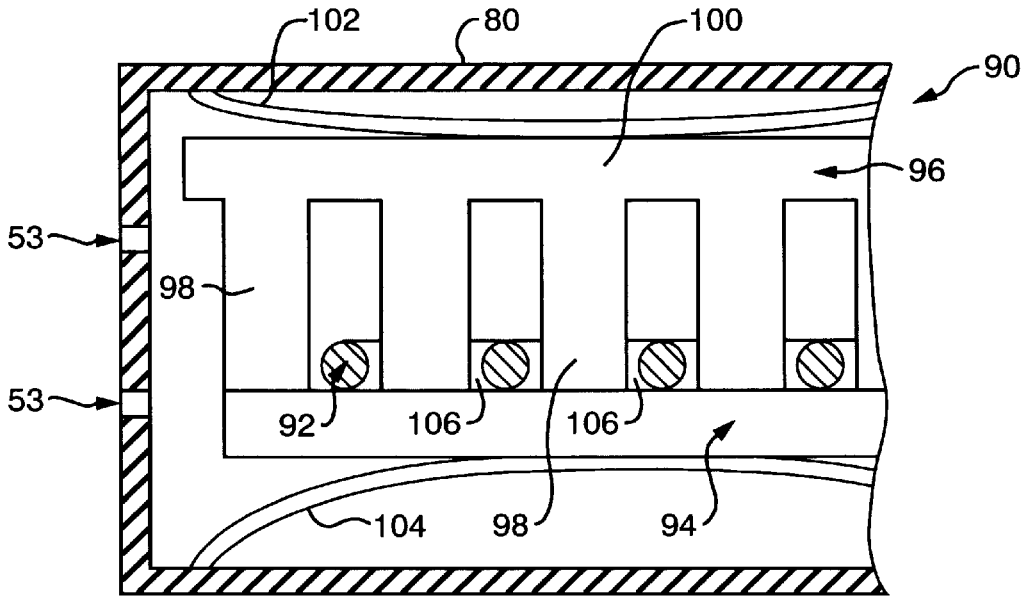
FIG. 5 is a partial cross-sectional view of a second alternative embodiment of a current limiting device of the present invention, wherein the current limiting device is shown in the closed position.
Figure 6:
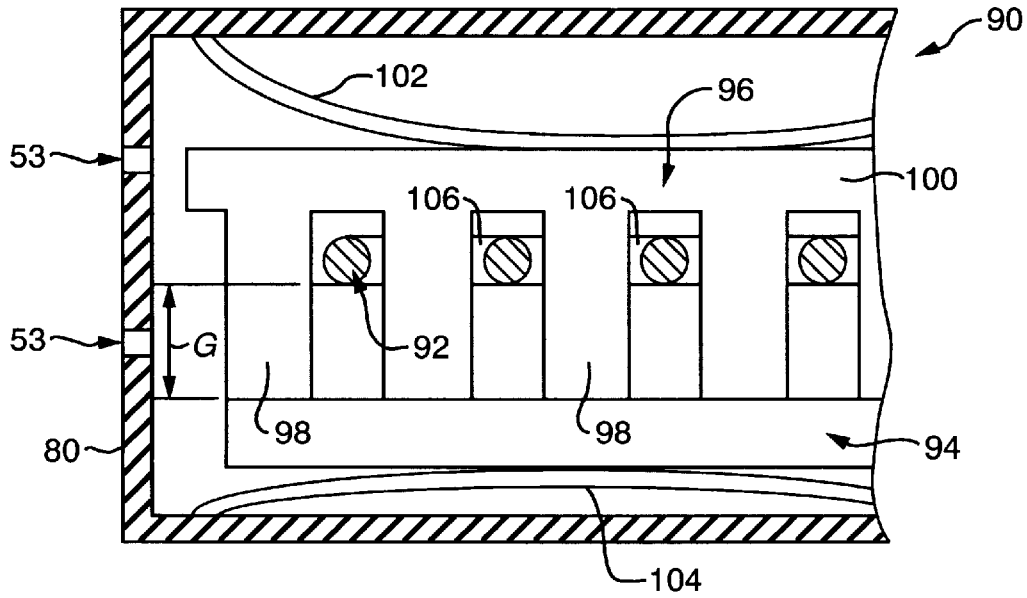
FIG. 6 is a partial cross-sectional view of the current limiting device of FIG. 5 wherein the current limiting device is shown in the open position.

FIGS. 5 and 6 illustrate a further embodiment a current limiting device 90 of the present invention, which is similar to the embodiment 50 of FIGS. 3 and 4. The current limiting device 90 includes a fixed or stationary electrode 92 disposed intermediate a movable electrode 94 and an ablative member 96. The movable electrode 94 is a solid planar member similar to the fixed electrode 54 of FIG. 3. The ablative member 96 of similar construction as the ablative member 68 of FIG. 3 is formed of ablative material. The ablative member 96 has a plurality of cylindrical members 98 extending downward from a planar portion 100 that engage the movable electrode 94. The ablative member 96 and movable electrode 94 are urged together by an ablative member spring 102 that urges the ablative member downward and an electrode spring 104 that urges the movable electrode 94 upward.

A portion of the fixed electrode 92 may be formed of a wire mesh that includes a plurality of openings 106 for receiving the cylindrical members 98 of the ablative members 96. One will appreciate that the fixed electrode 92 may be similar to the movable electrode 54 of FIG. 4.

FIG. 5 is illustrative of the current limiting device 90 during normal operation when no fault condition is present. During normal operation, the force of the electrode spring 104, which is greater than the force of the ablative member springs 102, urges the movable electrode 94 upward against the fixed electrode 92 to permit current to pass therebetween to the protected load.

During an overcurrent or ground fault condition, the movable electrode 94 repels from the fixed electrode 92 as shown in FIG. 6. As described hereinbefore, the electrode spring 104 defines the setpoint of the current trip level of the current limiting device 90. As the movable electrode 94 repels from the fixed electrode 92, the ablative member 96 is maintained in contact with the fixed electrode during the operation of the current limiting device 90. The ablative member 96 acts to quench the arc created between the electrodes 92, 94.

In this alternate embodiment efficient mixing of the expulsion gasses occurs because the ablative material of the ablative member 96 comprising the cylindrical legs 98 is inserted into the middle of the arc, which is generated during the opening of the electrodes 92, 94.

An advantage of the current limiting device as illustrated is to provide a device having low contact resistance between the electrodes and low erosion rate and faster interruption by separating the electrode from the ablative material.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims.

What is claimed is:

1. A current limiting device comprising:

a case;

a pair of separable electrodes each having an inner face and an outer face, said pair of electrodes being disposed in the case so that said inner face of one of said pair of electrodes faces said inner face of another of said pair of electrodes, said each electrode having at least one opening;

a pair of members formed of ablative material, each ablative member disposed over the opening and abutting said outer surface of a respective electrode; and a spring for urging the pair of separable electrodes together.

2. The current limiting device of claim 1 wherein each electrode includes a portion recessed inwardly to provide a cavity for receiving a respective ablative member.

3. The current limiting device of claim 1 wherein the pair of separable electrodes include a plurality of openings.

4. The current limiting device of claim 3 wherein the pair of separable electrodes comprise a wire mesh.

5. The current limiting device of claim 1 wherein each electrode is formed of at least one of copper, silver, silver-plated copper, silver tungsten, silver cadmium-oxide and silver tin oxide.

6. The current limiting device of claim 1 wherein each ablative member comprises at least one of cellulose filled melamine formaldehyde, nylon and epoxy.

7. The current limiting device of claim 1 wherein said ablative member comprises a polymer material.

8. The current limiting device of claim 7 wherein said polymer material includes at least one of a reinforcing filler and an extending filler.

9. The current limiting device of claim 1 wherein the spring comprises a leaf spring.

10. The current limiting device of claim 1 further comprising a resister having two leads, each lead electrically connected to a respective one of said electrodes.

11. The current limiting device of claim 1 wherein the case includes at least one vent disposed therein.

12. The current limiting device of claim 1 wherein at least one of the electrodes comprises a bimetallic material.

13. A current limiting device comprising:

a case;

a first electrode disposed in the case;

a second electrode disposed in the case in separable abutting relationship, the second electrode having at least one opening;

a member formed of ablative material, the ablative member including a leg portion passing through the opening of the second electrode to contact the first electrode;

an ablative member spring urging the ablative member against the first electrode; and an electrode spring urging the second electrode against the first electrode.

14. The current limiting device of claim 13 wherein the case includes at least one vent.

15. The current limiting device of claim 13 wherein one of the first and second electrodes comprises a bimetallic material.

16. The current limiting device of claim 13 wherein the first and second electrodes comprise at least one of copper, silver, silver-plated copper, silver tungsten, silver cadmium-oxide and silver tin oxide.

17. The current limiting device of claim 13 wherein the ablative member comprises at least one of cellulose filled melamine formaldehyde, nylon and epoxy.

18. The current limiting device of claim 13 further including a resister having two leads, each of said two leads electrically connected to a respective one of said first and second electrodes.

19. The current limiting device of claim 13 wherein the first electrode is a fixed electrode and the second electrode is a movable electrode.

20. The current limiting device of claim 13 wherein the electrode spring comprises a coil spring.

21. The current limiting device of claim 13 wherein the ablative member spring comprises a coil spring.

22. The current limiting device of claim 13 wherein the second electrode includes a plurality of openings.

23. The current limiting device of claim 22 wherein the second electrode comprises a plurality of openings and the ablative member includes a plurality of leg portions passing through a respective opening to contact the first electrode.

24. The current limiting device of claim 13 wherein the first electrode is a movable electrode and the second electrode is a fixed electrode.

25. The current limiting device of claim 13 wherein said ablative member comprises a polymer material.

26. The current limiting device of claim 25 wherein said polymer material includes at least one of a reinforcing filler and an extending filler.

* * * * *